US007103191B1

(12) United States Patent
Killion

(10) Patent No.: US 7,103,191 B1
(45) **Date of Patent: *Sep. 5, 2006**

(54) HEARING AID HAVING SECOND ORDER DIRECTIONAL RESPONSE

(75) Inventor: Mead C. Killion, Elk Grove Village, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 387 days.

This patent is subject to a terminal disclaimer.

(21) Appl. No.: 09/969,064

(22) Filed: Oct. 2, 2001

Related U.S. Application Data

(63) Continuation of application No. 09/624,805, filed on Jul. 24, 2000, which is a continuation of application No. 08/955,271, filed on Oct. 21, 1997, now Pat. No. 6,101,258, which is a continuation of application No. 08/632,517, filed on Apr. 12, 1996, now abandoned, which is a continuation of application No. 08/046,241, filed on Apr. 13, 1993, now Pat. No. 5,524,056.

(51) Int. Cl.
*H04R 25/00* (2006.01)

(52) U.S. Cl. ..... 381/313; 381/312; 381/328

(58) Field of Classification Search ..... 381/312, 381/313, 322, 327, 328, 330, 355, 356, 357, 381/358, FOR. 127, FOR. 128, FOR. 133
See application file for complete search history.

(56) References Cited

U.S. PATENT DOCUMENTS

| | | | |
|---|---|---|---|
| 2,950,357 | A | 8/1960 | Mitchell et al. |
| 3,770,911 | A | 11/1973 | Knowles et al. |
| 3,835,263 | A | 9/1974 | Killion |
| 3,875,349 | A | 4/1975 | Ruegg |
| 3,975,599 | A | 8/1976 | Johanson |
| 3,983,336 | A | 9/1976 | Malek et al. |

(Continued)

FOREIGN PATENT DOCUMENTS

| | | |
|---|---|---|
| CH | 533 408 | 1/1973 |
| DE | 1 938 435 | 2/1971 |
| DE | 3207412 A1 | 9/1983 |
| EP | 4 99 699 A1 | 2/1991 |
| GB | BP1 296 137 | 11/1972 |

OTHER PUBLICATIONS

Notice of Opposition to a European Patent dated Apr. 24, 2003 by Betten & Resch Patentanwalte Association No. 103 to European Patent No. 0664071 (Application No. 94 914 124.6).*
Killion, "Design and Evaluation Of High–Fidelity Hearing Aids," 1979.

*Primary Examiner*—Huyen Le
(74) *Attorney, Agent, or Firm*—McAndrews, Held & Malloy, Ltd.

(57) ABSTRACT

A hearing aid apparatus is disclosed that employs both an omnidirectional microphone and at least one directional microphone of at least the first order. The electrical signals output from the directional microphone are supplied to an equalization amplifier which at least partially equalizes the amplitude of the low frequency electrical signal components of the electrical signal with the amplitude of the mid and high frequency electrical signal components of the electrical signals of the directional microphone. A switching circuit accepts the signals output from both the omnidirectional microphone and the directional microphone. The switching circuit connects the signal from the omnidirectional microphone to an input of a hearing aid amplifier when the switching circuit is in a first switching state, and connects the output of the equalization circuit to the hearing aid amplifier input when the switching circuit is in a second switching state. The switching circuit may be automatically switched in response to sensed ambient noise levels.

27 Claims, 12 Drawing Sheets

U.S. PATENT DOCUMENTS 4,073,366 A 2/1978 Estes
4,393,270 A 7/1983 van den Berg
4,399,327 A 8/1983 Yamamoto et al.
4,456,795 A 6/1984 Saito
4,622,440 A 11/1986 Slavin
4,703,506 A 10/1987 Sakamoto et al.
4,742,548 A * 5/1988 Sessler et al. ..... 381/92
5,058,171 A 10/1991 Wurzer et al.
5,121,426 A 6/1992 Baumhauer, Jr. et al.
5,131,046 A 7/1992 Killion et al.
5,201,066 A 4/1993 Kim
5,214,709 A 5/1993 Ribic
5,289,544 A * 2/1994 Franklin ..... 381/327
5,524,056 A 6/1996 Killion et al.
6,101,258 A 8/2000 Killion et al.
6,285,771 B1 9/2001 Killion et al.
6,327,370 B1 * 12/2001 Killion et al. ..... 381/313

* cited by examiner

HEARING AID HAVING SECOND ORDER DIRECTIONAL RESPONSE

CROSS-REFERENCE TO RELATED APPLICATIONS

This application is a continuation of U.S. application Ser. No. 09/624,805 filed Jul. 24, 2000, which is a continuation of U.S. application Ser. No. 08/955,271 filed Oct. 21, 1997, now U.S. Pat. No. 6,101,258 issued Aug. 8, 2000, which is a continuation of U.S. application Ser. No. 08/632,517 filed Apr. 12, 1996, now abandoned, which is a continuation of U.S. application Ser. No. 08/046,241 filed Apr. 13, 1993, now U.S. Pat. No. 5,524,056 issued Jun. 4, 1996.

INCORPORATION BY REFERENCE

U.S. Pat. No. 5,524,056, U.S. Pat. No. 6,101,258 and U.S. application Ser. No. 09/624,805 are hereby incorporated herein by reference in their entirety.

STATEMENT REGARDING FEDERALLY SPONSORED RESEARCH OR DEVELOPMENT

FIELD OF THE INVENTION

This invention relates to improvements in the use of directional microphones for hearing aids that are used in circumstances where the background noise renders verbal communication difficult. More particularly, the present invention relates to a microphone system for such a hearing aid.

BACKGROUND OF THE INVENTION

Individuals with impaired hearing often experience difficulty understanding conversational speech in background noise. What has not heretofore been well understood is that the majority of daily conversations occur in background noise of one form or another. In some cases, the background noise may be more intense than the target speech, resulting in a severe signal-to-noise ratio problem. In a study of this signal-to-noise problem, Preasons et al, "Speech levels in various environments," Bolt Beranek and Newman report No. 3281, Washington, D.C., October 1976, placed a head-worn microphone and tape recorder on several individuals and sent them about their daily lives, obtaining data in homes, automobiles, trains, hospitals, department stores, and airplanes. They found that nearly ¼ of the recorded conversations took place in background noise levels of 60 dB sound pressure level (SPL) or greater, and that nearly all of the latter took place with a signal-to-noise ratio between −5 dB and +5 dB. (A signal-to-noise ratio of −5 dB means the target speech is 5 dB less intense than the background noise.) As discussed in a review by Mead Killion, "The Noise Problem: There's hope," Hearing Instruments Vol. 36, No. 11, 26–32 (1985), people with normal hearing can carry on a conversation with a −5 dB signal-to-noise ratio, but those with hearing impairment generally require something like +10 dB. Hearing impaired individuals are thus excluded from many everyday conversations unless the talker raises his or her voice to an unnatural level. Moreover, the evidence of Carhart and Tillman, "Interaction of competing speech signals with hearing losses," *Archives of Otolaryngology*, Vol. 91, 273–9 (1970), indicates that hearing aids made the problem even worse. More recent studies by Hawkins and Yacullo, "Signal-to-noise ratio advantage of binaural hearing aids and directional microphones under different levels of reverberation," *J. Speech and Hearing Disorders*, Vol. 49, 278–86 (1984), have shown that hearing aids can now help, but still leave the typical hearing aid wearer with a deficit of 10–15 dB relative to a normal-hearing person's ability to hear in noise.

One approach to the problem is the use of digital signal processors such as described in separate papers by Harry Levitt and Birger Kollmeier at the 15th Danavox Symposium "Recent development in hearing instrument technology," Scanticon, Kolding, Denmark, Mar. 30 through Apr. 2, 1993 (to be published as the *Proceedings of the 15th Danavox Symposium*). This approach, using multiple microphones and high-speed digital processors, provide a few dB improvement in signal-to-noise ratio. The approach, however, requires very large research expenditures, and, at present, large energy expenditures. It is estimated that the processor described by Levitt would require 40,000 hearing aid batteries per week to keep it powered up. One of the approaches described by Kollmeier operated at 400 times slower than real time, indicating 400 SPARC processors operating simultaneously would be required to obtain real-time operation, for an estimated expenditure of 60,000 hearing aid batteries per hour. Such digital signal processing schemes therefore hold little immediate hope for the hearing aid user.

First-order directional microphones have been used in behind-the-ear hearing aids to improve the signal-to-noise ratio by rejecting a portion of the noise coming from the sides and behind the listener. Carlson and Killion, "Subminiature directional microphones", *J. Audio Engineering Society*, Vol. 22, 92–6 (1974), describe the construction and application of such a subminiature microphone suitable for use in behind-the-ear hearing aids. Hawkins and Yacullo (see above) found that such a microphone could improve the effective signal-to-noise ratio by 3–4 dB.

First-order directional microphones, however, are not without their drawbacks when utilized in the in-the-ear hearing aids employed by some 75% of hearing aid wearers. The experimental sensitivity of a first-order directional microphone is typically 6–8 dB less when mounted in an in-the-ear hearing aid compared to its sensitivity in a behind-the-ear mounting. These results come about because of the shortened distance available inside the ear and the effect of sound diffraction about the head and ear. An additional problem with directional microphones in head-worn applications is that the improvement they provide over the normal omni-directional microphone is less than occurs in free-field applications because the head and pinna of the ear provide substantial directionality at high frequencies. Thus in both behind-the-ear and in-the-ear applications, the directivity index (ratio of sensitivity to sound from the front to the average sensitivity to sounds from all directions) might be 4.8 dB for a first-order directional microphone tested in isolation and 0 dB for an omnidirectional microphone tested in isolation. When mounted on the head, however, the omnidirectional microphone might have a directivity index of 3 dB at high frequencies and the directional microphone perhaps 5.5 dB. As a result, the improvement in the head-mounted case is 2.5 dB. An approach exploiting microphone directional sensitivity was pursued by Wim Soede. That approach utilizes 5-microphone directional arrays suitable for head-worn applications. The array and its theoretical description are described in his Ph.D. dissertation "Development and evaluation of a new directional hearing instrument based on array technology," Gebotekst Zoetermeet/1990, Delft University of Technology, Delft, The Netherlands. The array provided a directivity index of 10 dB or greater. The problem with this array approach is that the Soede array is 10 cm long, requiring eyeglass-size hearing aids. It is certainly not practical for the in-the-ear hearing aids most often used in the United States. While there may be many individuals whose loss is so severe that the improved signal-to-noise obtained with such a head-worn array would make it attractive, a majority of hearing aid wearers would find the size of the array unattractive.

Second-order directional microphones are more directionally sensitive than their first order counterparts. Second-order directional microphones, however, have always been considered impractical because their sensitivity is so low. The frequency response of a first-order directional microphone falls off at 6 dB/octave below about 2 kHz. The frequency response of a second-order directional microphone falls off at 12 dB/octave below about 2 kHz. At 200 Hz, therefore, the response of a second-order directional microphone is 40 dB below that of it's comparable omnidirectional microphone. If electrical equalization is used to restore the low-frequency response, the amplified microphone noise will be 40 dB higher. The steady hiss of such amplified microphone noise is objectionable in a quiet room, and hearing aids with equivalent noise levels more than about 10–15 dB greater than that obtained with an omnidirectional microphone have been found unacceptable in the marketplace. For similar reasons, first order microphones have likewise not gained wide acceptance for use in hearing aids.

SUMMARY OF THE INVENTION

It is an object of the present invention to provide an improved speech intelligibility in noise to the wearer of a small in-the-ear hearing aid.

It is a further object of the present invention to provide the necessary mechanical and electrical components to permit practical and economical second-order directional microphone constructions to be used in head-worn hearing aids.

It is a still further object of the present invention to provide a switchable noise-reduction feature for a hearing aid whereby the user may switch to an omni-directional microphone for listening in quiet or to music concerts, and then switch to a highly-directional microphone in noisy situations where understanding of conversational speech or other signals would otherwise be difficult or impossible.

It is a still further object of the present invention to provide an automatic switching function which, when activated, will automatically switch from the omnidirectional microphone to a directional microphone whenever the ambient noise level rises above a certain predetermined value, such switching function taking the form of a "fader" which smoothly attenuates one microphone and brings up the sensitivity on the other over a range of overall sound levels so that no click or pop is heard.

These and other objects of the invention are obtained in a hearing aid apparatus that employs both an omnidirectional microphone and at least one directional microphone of at least the first order. The electrical signals output from the directional microphone are supplied to an equalization amplifier which at least partially equalizes the amplitude of the low frequency electrical signal components with the amplitude of the mid and high frequency electrical signal components of the directional microphone. A switching circuit accepts the signals output from both the omnidirectional microphone and the directional microphone. The switching circuit connects the signal from the omnidirectional microphone to an input of a hearing aid amplifier when the switching circuit is in a first switching state, and connects the output of the equalization circuit to the hearing aid amplifier input when the switching circuit is in a second switching state.

Several switching circuit embodiments are set forth. In one embodiment, the switching circuit is manually actuatable by a wearer of the hearing aid. In a further embodiment, the switching circuit is operated automatically in response to the level of sensed ambient noise to switch directly between the first and second switching states. In a still further embodiment, the switching circuit is operated automatically as a fader circuit in response to the level of sensed ambient noise to gradually switch between the first and second states thereby providing a gradual transition between the microphones.

In a further embodiment of the invention three different types of microphones are employed: an omnidirectional microphone, a first order microphone, and a second order microphone. The microphone outputs are gradually switched to the input of the hearing aid amplifier in response to the sensed level of ambient noise.

In one embodiment of the invention, the directional microphone is of the second order. The second order microphone is constructed from two first order gradient microphones that have their output signals subtracted in a subtracter circuit. The output of the subtracter circuit provides a second order directional response. Optionally, diffraction scoops may be disposed over the sound ports of the first order gradient microphones to increase their sensitivity. Hearing aid performance may be further increased by employing a windscreen in addition to the diffraction scoops.

BRIEF DESCRIPTION OF THE DRAWINGS

Other objects and features of the present invention may be further understood by reference to the following detailed description of the preferred embodiment of the invention taken in conjunction with the accompanying drawings, on which:

FIGS. 10–12 are graphs showing various signals of the circuit of

FIG. 9 as a function of sound pressure level;

It will be understood that the drawings are not necessarily to scale. In certain instances, details which are not necessary for understanding various aspects of the present invention have been omitted for clarity.

DETAILED DESCRIPTION OF THE INVENTION

Figure 1:
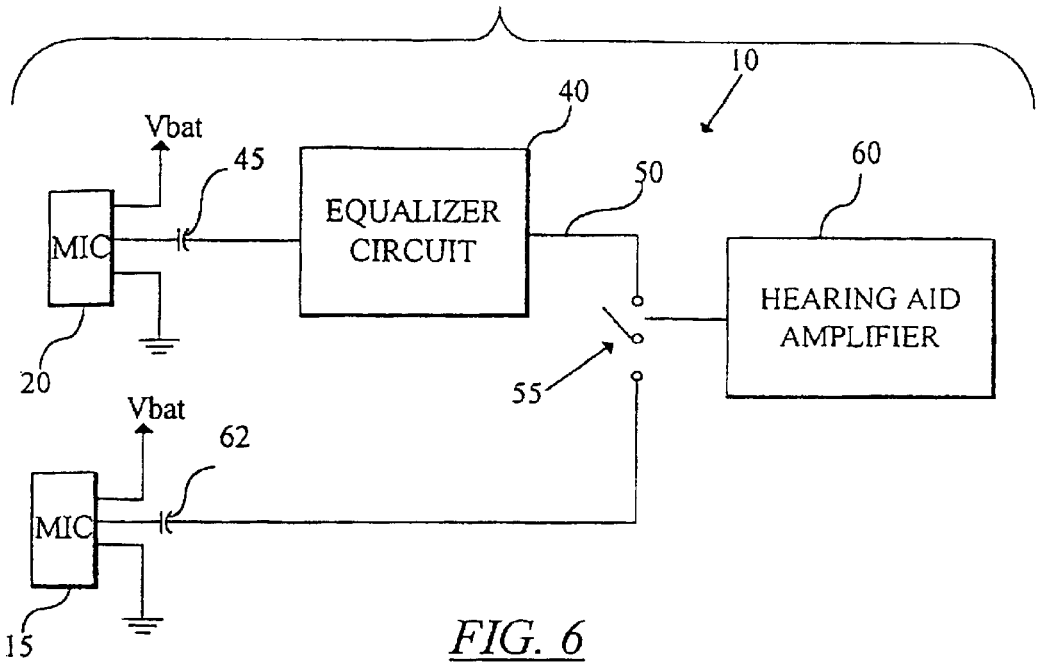
FIG. 1 is a schematic block diagram of one embodiment of a hearing aid apparatus constructed in accordance with the teachings of the invention.

A hearing aid apparatus constructed in accordance with one embodiment of the invention is shown generally at 10 of FIG. 1. As illustrated, the hearing aid apparatus 10 utilizes both an omnidirectional microphone 15 and a directional microphone 20 of at least the first order. Each of the microphones 15,20 is used to convert sound waves into electrical output signals corresponding to the sound waves.

Figure 2:
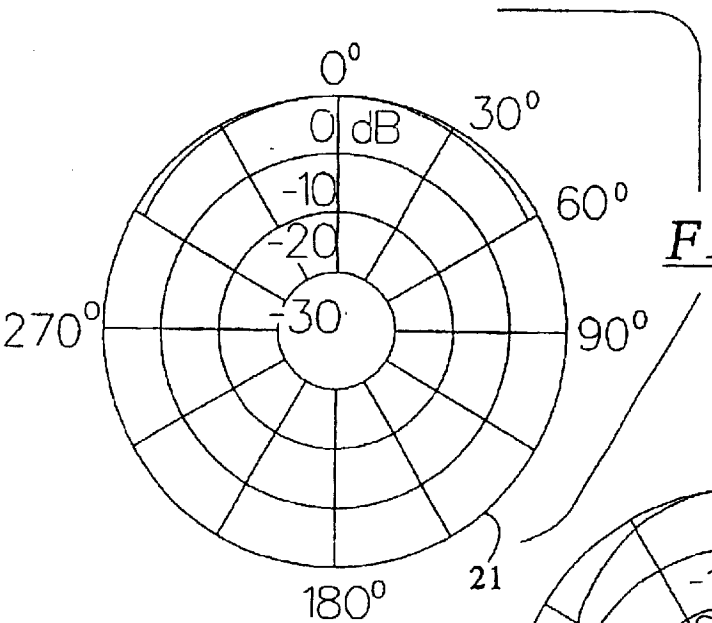
FIG. 2 is a polar chart showing the directional response of an omnidirectional microphone.
Figure 3:
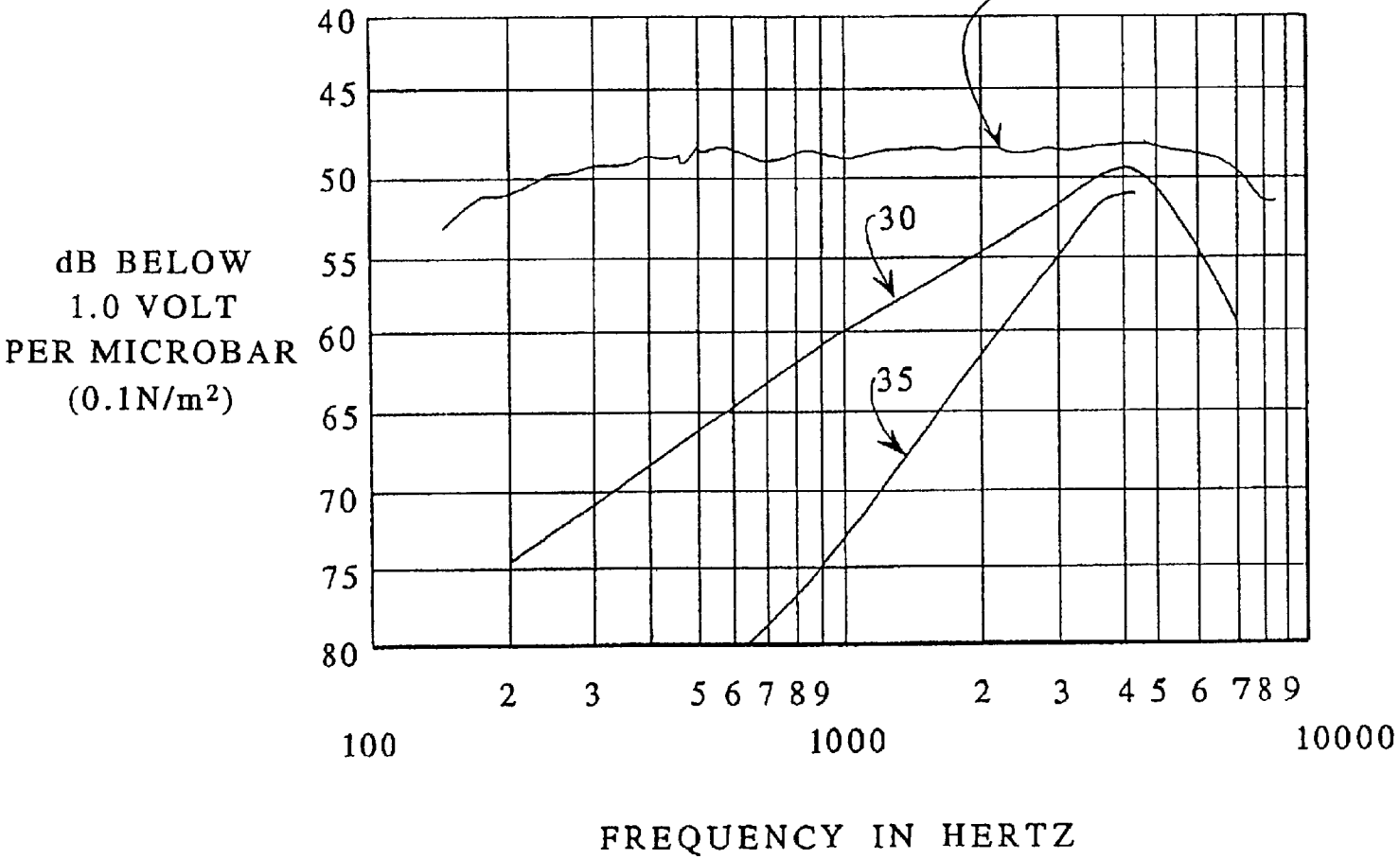
FIG. 3 is a graph of the frequency response of an omnidirectional microphone, a first order directional microphone, and a second order directional microphone.

The free space directional response of a typical omnidirectional microphone is shown by line 21 in FIG. 2 while the corresponding frequency response of such a microphone is shown by line 25 of FIG. 3. The directional and frequency response of a typical omnidirectional microphone make it quite suitable for use in low noise environments when it is desirable to hear sound from all directions. Such an omnidirectional microphone is particularly suited for listening to a music concert or the like.

Figure 4:
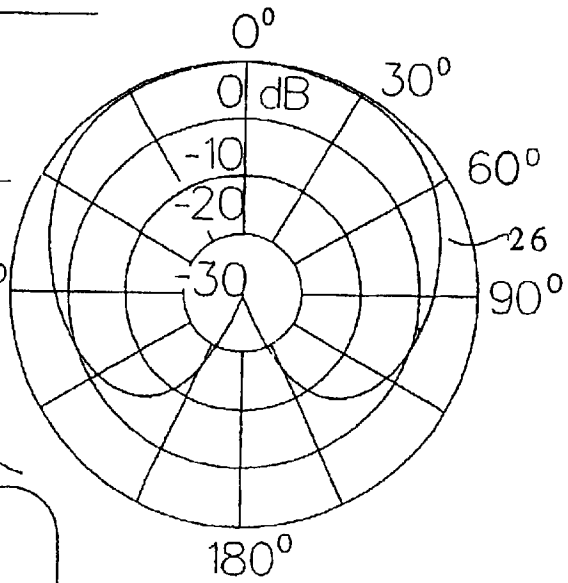
FIG. 4 is a polar chart showing a directional response of one type of first order directional microphone having cardioid directivity.

The free space directional response of one type of a first order directional microphone is set forth by line 26 in FIG. 4 and the corresponding frequency response is shown by line 30 of FIG. 2. As illustrated, the first order directional microphone tends to reject sound coming from the side and rear of the hearing aid wearer. As such, the directivity of a first-order directional microphone may be used to improve the signal-to-noise ratio of the hearing aid since it rejects a portion of the noise coming from the sides and behind the hearing aid wearer. The first order directional microphone, however, experiences decreased sensitivity to low frequency sound waves, sensitivity dropping off at a rate of 6 dB per octave below approximately 2 KHz.

Figure 5:
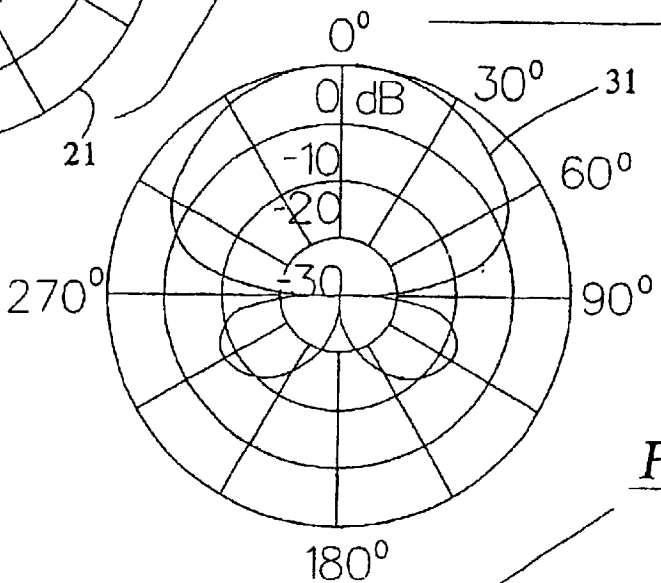
FIG. 5 is a polar chart showing a directional response of one type of a second order directional microphone.

The free space directional response of one type of a second order directional microphone is set forth by line 31 in FIG. 5 and the corresponding frequency response is shown by line 35 of FIG. 2. As illustrated, the second order directional microphone is even more directional than the first order microphone and, as such, tends to improve the signal-to-noise ratio of the hearing aid to an even greater degree than the first order microphone. The second order directional microphone, however, is even less sensitive to low frequency sound waves than its first order counterpart, sensitivity dropping off at a rate of 12 dB per octave below approximately 2 KHz.

Referring again to FIG. 1, the output of the directional microphone 20 is AC coupled to the input of an equalizer circuit 40 through capacitor 45. The equalizer circuit 40 at least partially equalizes the amplitude of the low frequency components of the electrical signal output from the directional microphone 20 with the amplitude of the mid and high frequency components of the electrical signal output. This equalization serves to compensate for the decreased sensitivity that the directional microphone provides at lower frequencies. The equalizer circuit 40 provides the equalized signal at output line 50.

As explained above, the equalizer circuit 40 raises the noise level of the hearing aid system. The noise level is significantly raised when a second order microphone is equalized. This noise is quite noticeable to the hearing aid wearer when the hearing aid is used in low ambient noise situations, but tends to become masked in high ambient noise level situations. It is in high ambient noise level situations that the directionality of the directional microphone is most useful for increasing the signal to noise ratio of the hearing aid system. Accordingly, the equalized electrical signal output from the equalizer circuit 40 and the electrical signal output from the omnidirectional microphone 15 are supplied to opposite terminals of a SPDT switch 55 that has its pole terminal connected to the input of a hearing aid amplifier 60. The electrical signal output from omnidirectional microphone 15 is AC coupled through capacitor 62. The hearing aid amplifier 60 may be of the type shown and described in U.S. Pat. No. 5,131,046, to Killion et al, the teachings of which are hereby incorporated by reference.

The SPDT switch 55 has at least two switching states. In a first switching state, the electrical signal from the omnidirectional microphone 15 is connected to the input of the hearing aid amplifier 60 to the exclusion of the equalized signal from the equalizer circuit 40. In a second switching state, the equalized electrical signal from the equalizer circuit 40 is connected to the input of the hearing aid amplifier 60 to the exclusion of the electrical signal from the omnidirectional microphone 15. Microphone selection, such as is disclosed herein, allows optimization of the signal-to-noise ratio of the hearing aid system dependent on the ambient noise conditions. As will be set forth in more detail below, such selection can be done either manually or automatically.

Figure 6:
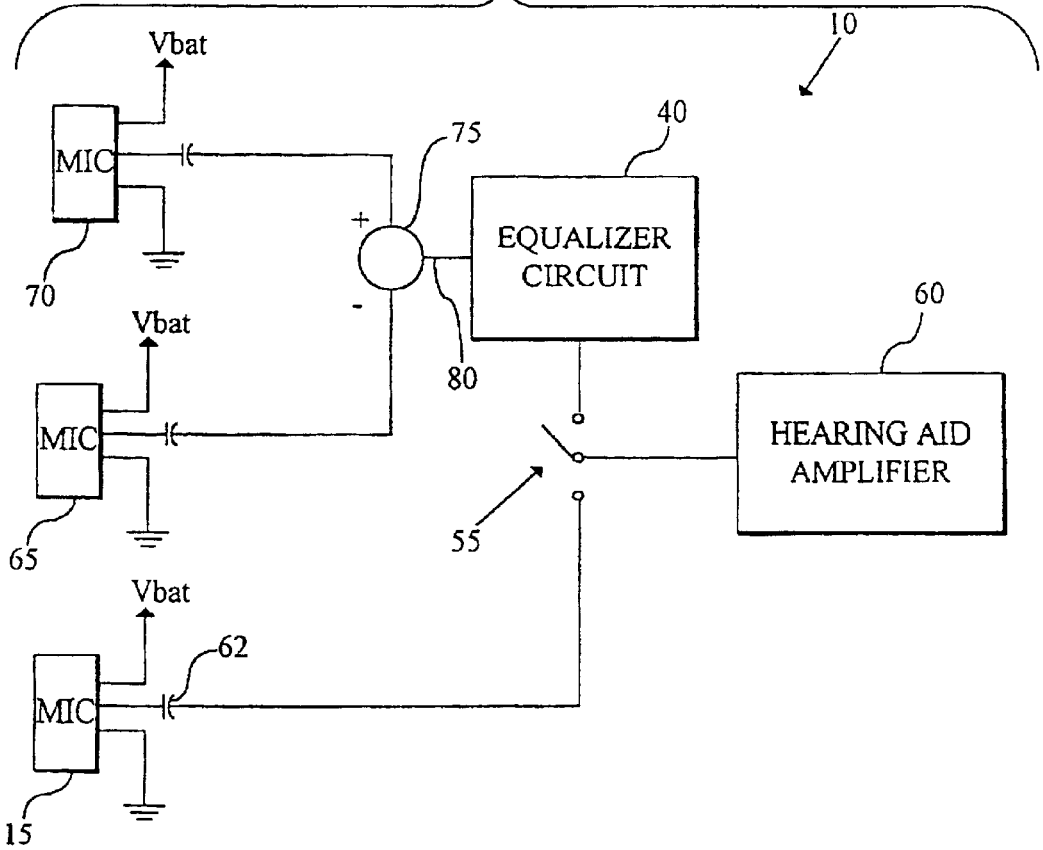
FIG. 6 is a schematic block diagram of a hearing aid apparatus of the invention that utilizes two first order directional microphones to produce a second order directional response.

FIG. 6 shows another embodiment of a hearing aid system 10. The hearing aid system 10 employs two first-order directional microphones 65 and 70. The electrical signal output of directional microphone 70 is AC coupled to the positive input of a summing circuit 75 while the electrical signal output of directional microphone 65 is AC coupled to the negative input of the summing circuit 75. The directional microphones 65,70 have matched characteristics. The resultant electrical signal output on line 80 of the summing circuit 75 has second order directional and frequency response characteristics and is supplied to the input of the equalizer circuit 40.

Figure 7:
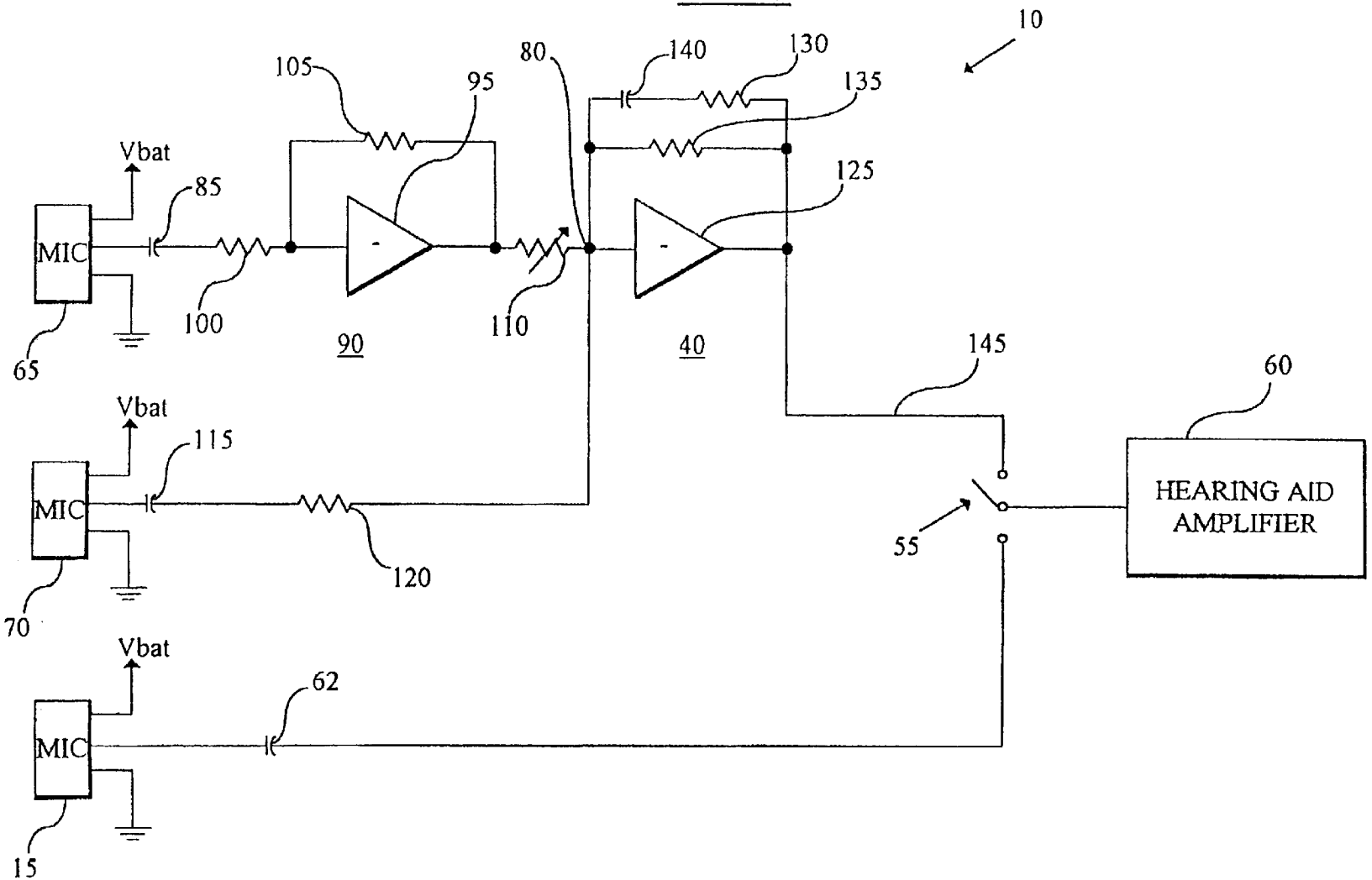
FIG. 7 is a more detailed circuit diagram of the circuit of FIG. 6.

A more detailed schematic diagram of the system shown in FIG. 6 is given in FIG. 7. As illustrated, the electrical signal output of first order directional microphone 65 is AC coupled through capacitor 85 to the input of an inverting circuit, shown generally at 90. The inverting circuit 90 includes an inverting amplifier 95, resistors 100 and 105, and balance resistor 110. The electrical signal output of first order microphone 70 is AC coupled through capacitor 115 to resistor 120 which, in turn, is connected to supply the electrical signal output to summuing junction 80.

The signal at summing junction 80 is supplied to the input of the equalizer circuit 40. The equalizer circuit 40 includes inverting amplifier 125, resistors 130 and 135, and capacitor 140. The equalized electrical signal output from the equalizer circuit 40 is supplied to switch 55 on line 145.

The components of the embodiment shown in FIG. 7 may have the following values and be of the following component types:

| Component | Description |
|---|---|
| 100, 105 | 27K |
| 85, 115 | .027MF |
| 110 | $25K_{variable}$ |
| 120 | 15K |
| 130 | 100K |
| 135 | 1M |
| 140 | 560 pf |
| 95, 125 | LX 509 of Gennum Corp. |

In an alternative embodiment of the switching system, the SPDT switch 55 can be replaced by an automatic switching system that switches between the directional microphone and the omnidirectional microphone dependent on sensed ambient noise levels. Such alternative embodiments are shown in FIGS. 8 and 9.

Figure 8:
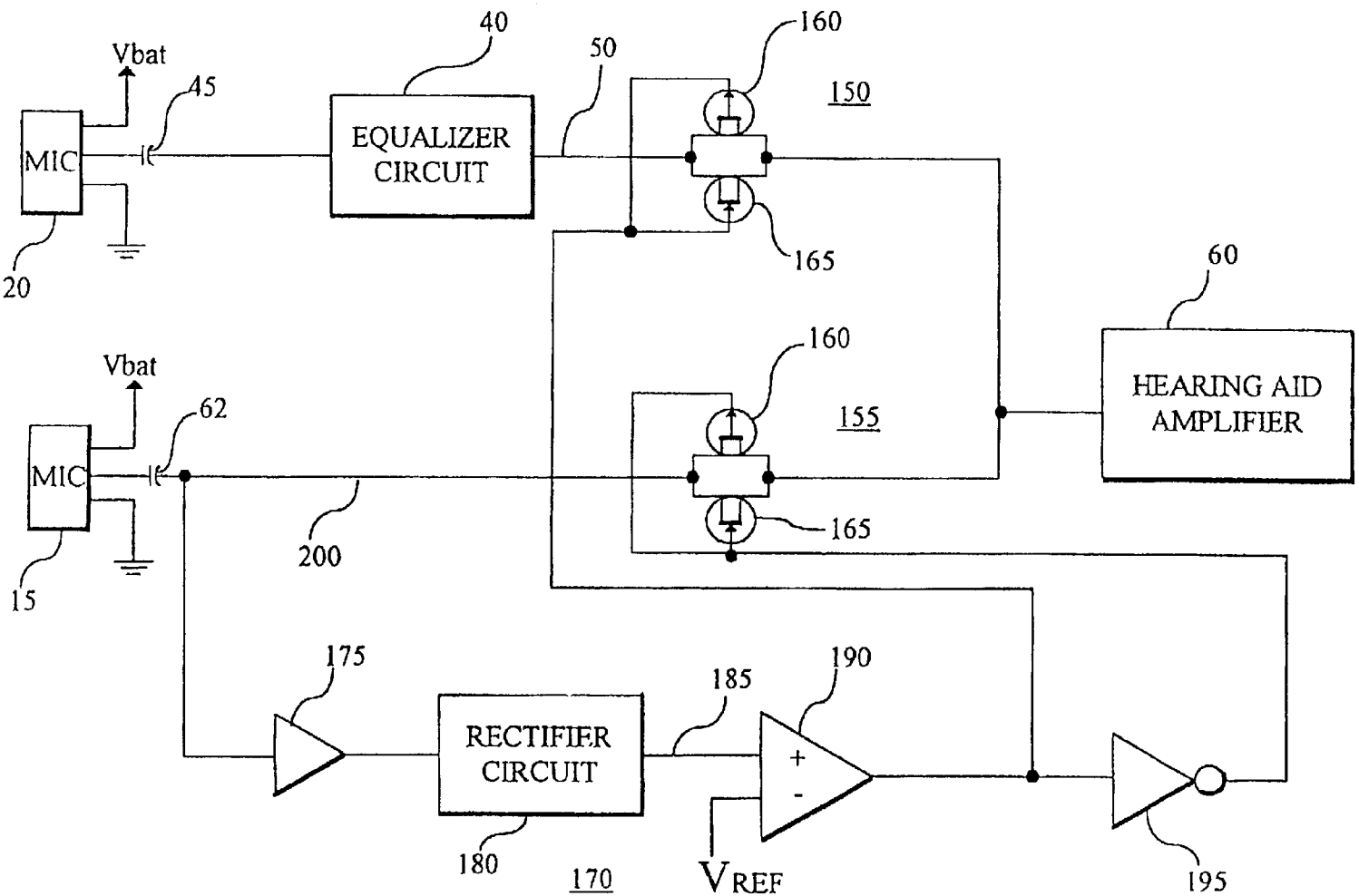
FIG. 8 is a schematic diagram of a hearing aid apparatus having automatic ambient-noise-level dependent switching between microphones.
Figure 9:
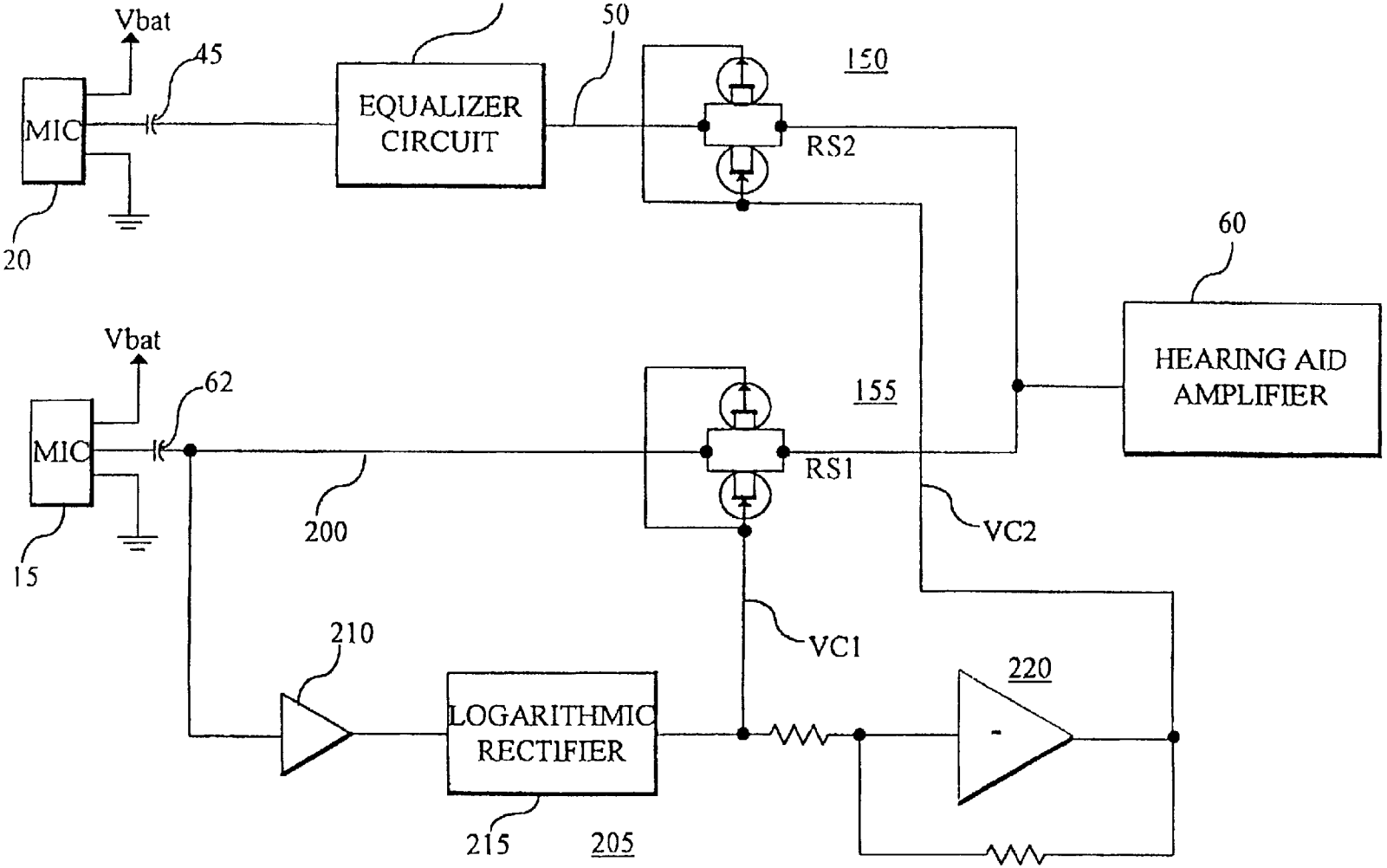
FIG. 9 is a schematic diagram of a hearing aid apparatus having automatic ambient-noise-level dependent switching between microphones wherein the switching is performed by a fader circuit.

The embodiment of FIG. 8 includes a directional microphone 20 of at least the first order and an omnidirectional microphone 15. The output of directional microphone 20 is supplied to the input of equalizer circuit 40 through capacitor 45. The equalized output signal from the equalizer is supplied on output line 50 to an FET switch 150. The output signal from omnidirectional microphone 15 is supplied through capacitor 62 to a further FET switch 155.

Each FET switch 150 and 155 includes two complementary FETs 160 and 165 arranged as series pass devices. Where the DC signal level at the input of hearing aid amplifier 60 is 0V (such as with the hearing aid amplifier design set forth in the above-noted U.S. Pat. No. 5,131,046), only a single FET (i.e., an N-channel FET) need be employed. The FET switches 150 and 155 receive respective control signals from a noise comparison circuit, shown generally at 170, to control their respective series pass resistances.

The noise comparison circuit 170 includes a noise sensing circuit portion and a control circuit portion. The noise sensing circuit portion includes an amplifier 175 that accepts the electrical output signal from omnidirectional microphone 15. The amplified output signal is supplied to the input of a rectifier circuit 180 which rectifies the amplified signal to provide a DC signal output on line 185 that is indicative of the ambient noise level detected by omnidirectional microphone 15.

The control circuit portion includes comparator 190 and logic inverter 195. The DC signal output from the rectifier circuit is supplied to the positive input of comparator 190 for comparison to a reference signal $V_{REF}$ that is supplied to the negative input of the comparator 190. The output of comparator 190 is a binary signal and is supplied as a control signal to FET switch 150. The output of the comparator is also supplied to the input of logic inverter 195, the output of which is supplied as a control signal to FET switch 155.

In operation, the signal $V_{REF}$ is set to a magnitude representative of a reference ambient noise level at which the hearing aid apparatus is to switch between the directional and omnidirectional microphones 20 and 15. For example, the signal $V_{REF}$ can be set to a level representative of a 65 dB ambient noise level. When the sensed ambient noise level thus rises above 65 dB, FET switch 150 will have a low series pass resistance level and will connect the equalized output signal at line 50 to the input of the hearing aid amplifier 60 while FET switch 155 will have a high series pass resistance and will effectively disconnect the electrical signal output of omnidirectional microphone 15 from the input of the hearing aid amplifier 60. When the ambient noise level drops below 65 dB, FET switch 155 will have a low series pass resistance level and will connect the electrical signal output of microphone 15 at line 200 to the input of the hearing aid amplifier 60 while FET switch 150 will have a high series pass resistance and will effectively disconnect the equalized signal output on line 50 from the input of the hearing aid amplifier 60. To avoid excessive switching at ambient noise levels near 65 dB, the comparator 190 may be designed to have a certain degree of hysteresis.

The reference signal $V_{REF}$ may be variable and may be set to a level that is optimized for the particular hearing aid wearer. To this end, reference signal $V_{REF}$ may be supplied from a voltage divider having a trimmer pot as one of its resistive components (not shown). The trimmer pot may be adjusted to set the optimal $V_{REF}$ value.

A further embodiment of a hearing aid apparatus that employs automatic switching is set forth in FIG. 9. The circuit of FIG. 9 is the same as that shown in FIG. 8 except that the noise comparison circuit 170 is replaced with a fader circuit, shown generally at 205.

The fader circuit 205 includes an amplifier 210 connected to receive the electrical signal output of omnidirectional microphone 15 through capacitor 62. The amplified signal is supplied to the input of a logarithmic rectifier 215 such as is shown and described in the aforementioned U.S. Pat. No. 5,131,046, but with reversed output polarity. The output of the logarithmic rectifier 215 is supplied as a control signal VC1 to FET switch 155 and is also supplied to the input of an inverting amplifier circuit 220 having a gain of 1. Where the output range of the logarithmic rectifier is insufficient to drive FET switch 155, an amplifier may be used the output of which would be supplied as the control signal VC1 and to the input of inverting amplifier circuit 220. The output of inverting amplifier 220 is supplied as a control signal VC2 to FET switch 150.

Figure 10:
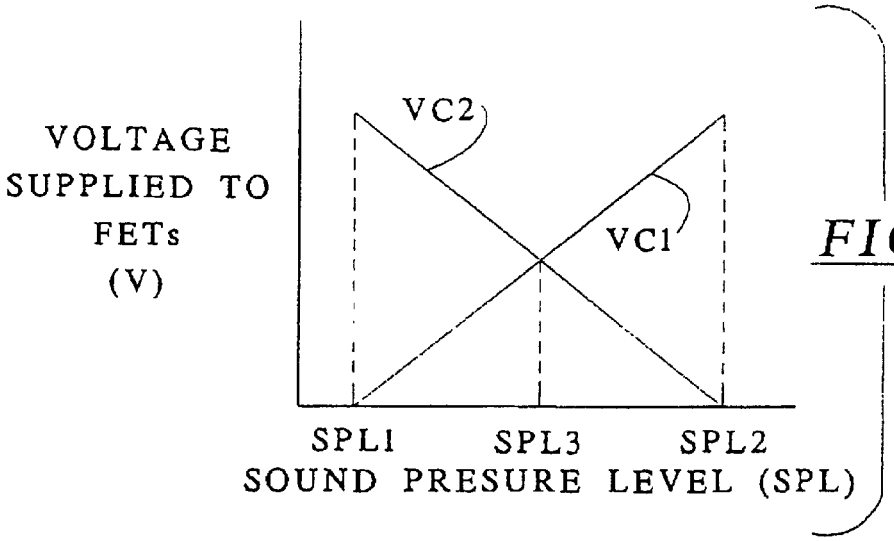

FIG. 10 is a graph of the control voltages VC1 and VC2 as a function of sound pressure level. As the ambient noise level increases there is an increase in the sound pressure level at omnidirectional microphone 15. This causes an increase of the level of control voltage VC1 while resulting in a corresponding decrease of the level of control voltage VC2. Similarly, as ambient noise level decreases there is a decrease in the sound pressure level at omnidirectional microphone 15. This causes an increase of the level of control voltage VC2 while resulting in a corresponding decrease of the level of control voltage VC1.

Figure 11:
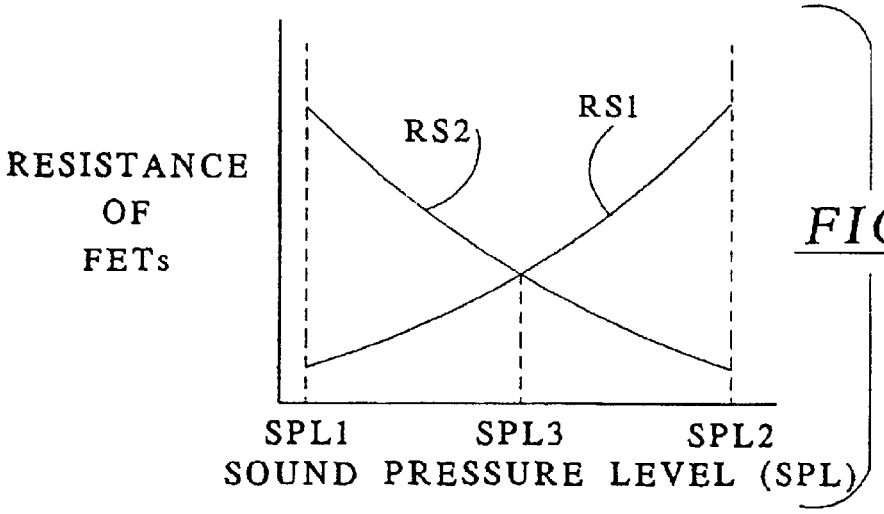

FIG. 11 is a graph of the resistances RS1 and RS2 respectively of FET switches 155 and 150 as a function of sound pressure level. As the ambient noise level and, thus, the sound pressure level, increases, there is a corresponding increase in the series resistance RS1 of FET switch 155 and a decrease in the series resistance RS2 of FET switch 150. At the input to the hearing aid amplifier 60, there is thus an increase in the relative level of the signal received from directional microphone 20 and a decrease in the relative level of the signal received from the omnidirectional microphone 15. As the ambient noise level and, thus, the sound pressure level decreases, there is a corresponding increase in the series resistance RS2 of FET switch 150 and a decrease in the series resistance RS1 of FET switch 155. At the input to the hearing aid amplifier 60, there is thus a decrease in the relative level of the signal received from the directional microphone 20 and a increase in the relative level of the signal received from the omnidirectional microphone 15. At some sound pressure level, here designated as SPL1, the omnidirectional microphone 15 is effectively completely connected to the input of the hearing aid amplifier 60 while the directional microphone 20 is effectively disconnected from the input of the hearing aid amplifier 60. At a further sound pressure level, here designated as SPL2, the directional microphone 20 is effectively completely connected to the input of the hearing aid amplifier 60 while the omnidirectional microphone 15 is effectively disconnected from the input of the hearing aid amplifier 60. In between these two sound pressure levels, there is a gradual transition between the two microphones. At sound pressure level SPL3, the contributions of both microphones are equal.

As is clear from the foregoing circuit description, the fader circuit gradually decreases the relative amplitude of the equalized signal supplied to the hearing aid amplifier while gradually increasing the relative amplitude of the electrical signal supplied to the hearing aid amplifier from the omnidirectional microphone as the level of ambient noise decreases. Likewise, the fader circuit gradually increases the relative amplitude of the equalized signal supplied to the hearing aid amplifier while gradually relative decreasing the amplitude of the electrical signal supplied to the hearing aid amplifier from the omnidirectional microphone as the level of the ambient noise increases.

Figure 12:
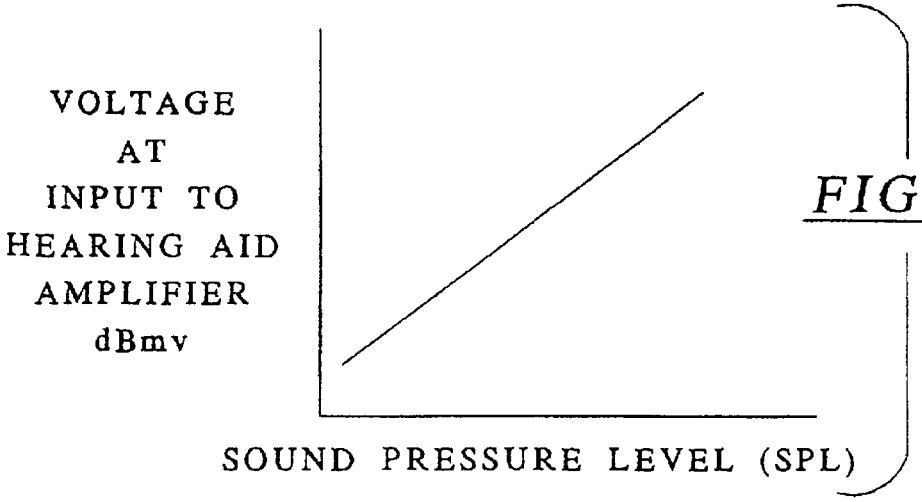

The fader circuit 205 may be designed so that the voltage at the input to the hearing aid amplifier 60 is a monotonic function of sound pressure level. This characteristic is illustrated in FIG. 12. A hearing aid apparatus having such characteristic would not present any noticeable deviation in sound output to the user as the apparatus transitions through the various sound pressure level states with variations in ambient noise levels.

As will be recognized by those skilled in the art, an amplified telecoil may be substituted for omnidirectional microphone 15 in FIG. 8, with $V_{ref}$ chosen to provide a switch in the output of comparator 190 when a sounding telephone is brought to the ear. Control of FET switch 155 is through the signal output of comparator 190 and control of FET switch 150 is through the output of inverter 195. This functions to connect the output of the telecoil to the input of hearing aid amplifier 60 and disconnect microphone 20 (which may be either an omnidirectional or directional microphone) whenever sufficient magnetic signal is available at the telephone thus avoiding the necessity of activating a manual switch whenever the hearing aid wearer uses the telephone. In some telecoil applications, the fader circuit of FIG. 9 may be used.

Figure 13:
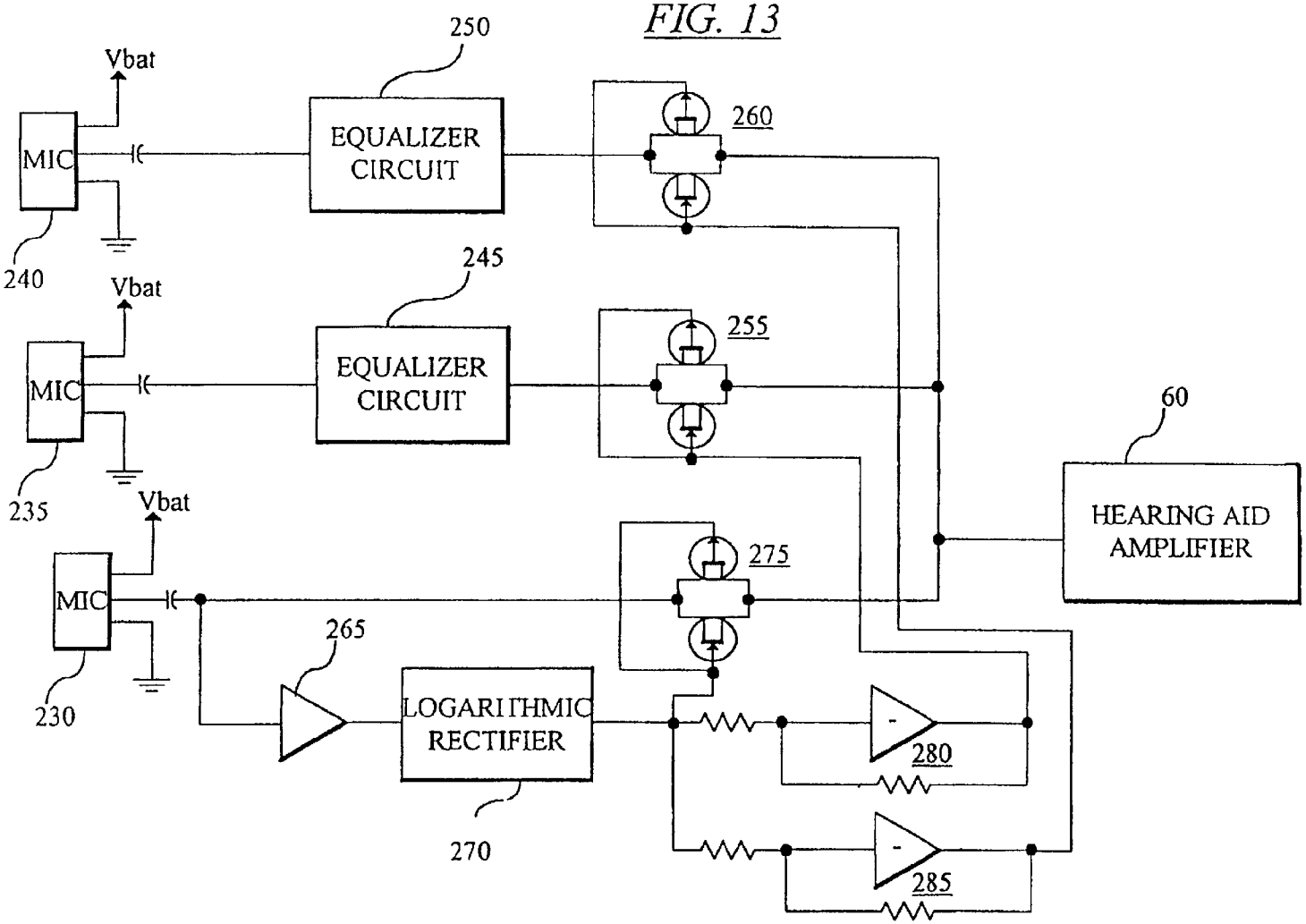
FIGS. 13–15 are schematic block diagrams of various constructions of a hearing aid apparatus and its associated components employing automatic switching between an omnidirectional microphone, a first order directional microphone, and a second order directional microphone.

FIG. 13 shows an embodiment of a hearing aid employing an omnidirectional microphone 230, a first order directional microphone 235, and a second order directional microphone 240. The directional microphones 235, 240 are AC coupled to respective equalizer circuits 245, 250. The output of equalizer circuit 245 is supplied to FET switch 255 and the output of equalizer 250 is supplied to FET switch 260.

Ambient noise is sensed at omnidirectional microphone 230, the output of which is supplied to amplifier 265 and therefrom to logarithmic rectifier 270. The output of microphone 230 is also AC coupled to FET switch 275. The output of logarithmic rectifier 270 is supplied to a first inverting amplifier circuit 280, a second inverting amplifier circuit 285, and directly to control FET switch 275. The gain of the inverting amplifiers 280 and 285 are chosen so that the omnidirectional microphone output signal dominates at the input of hearing aid amplifier 60 in low ambient noise conditions, the first order directional microphone output signal dominates at mid-level ambient noise conditions, and the second order microphone output dominates at high ambient noise conditions.

Figure 14:
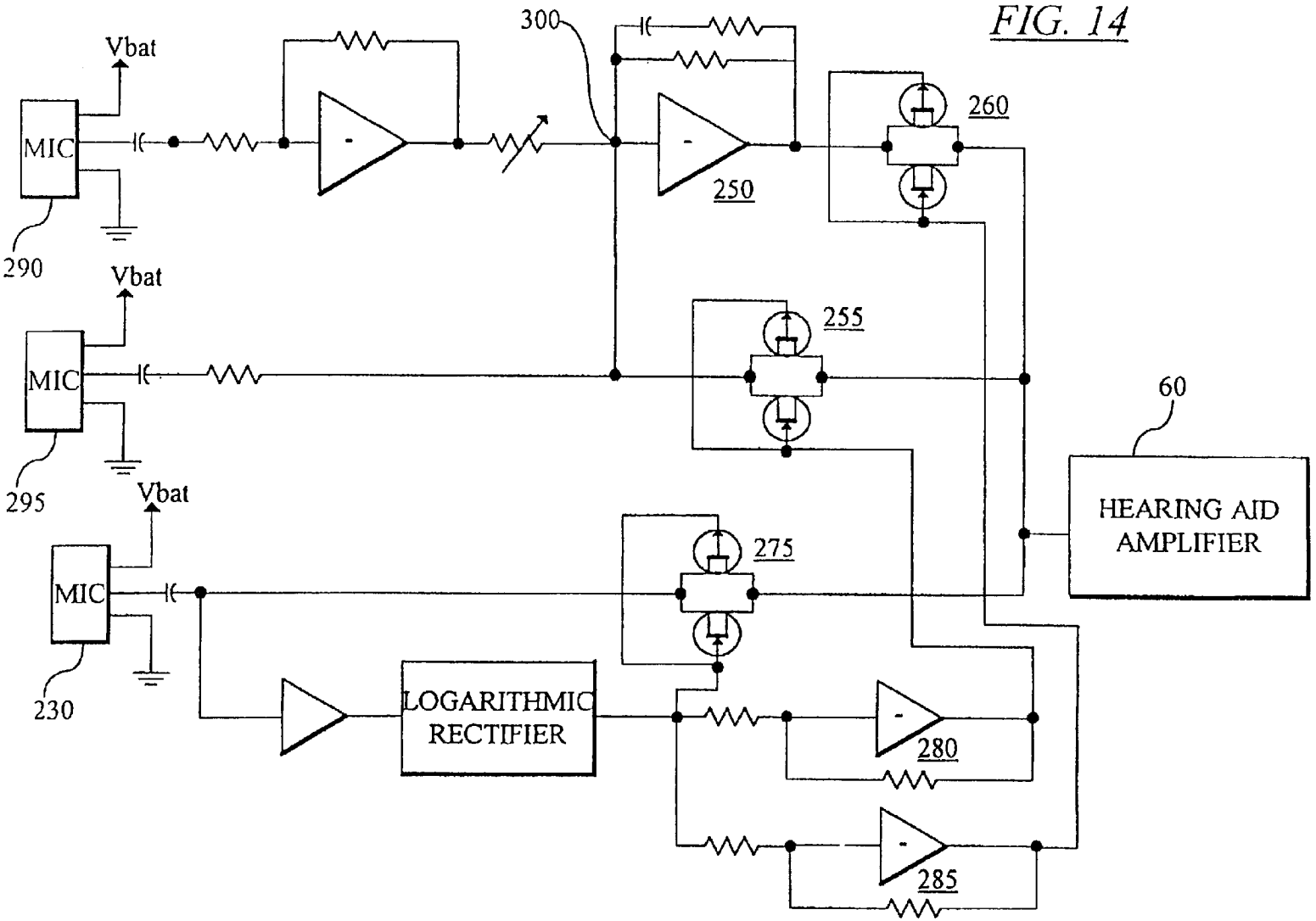

FIG. 14 shows an alternative design of the circuit of FIG. 13. In this arrangement, two first order microphones 290 and 295 are employed along with omnidirectional microphone 230. First order microphone 295 functions both as a first order directional microphone and as a portion of a second order directional microphone when the output of microphone 290 is subtracted from the output of microphone 295 at junction 300. Equalizer 245 is not utilized in this circuit for the sake of economy and will not drastically effect hearing aid performance since the lack of low frequency sensitivity of a first order microphone is within a tolerable range without equalization.

Figure 15:
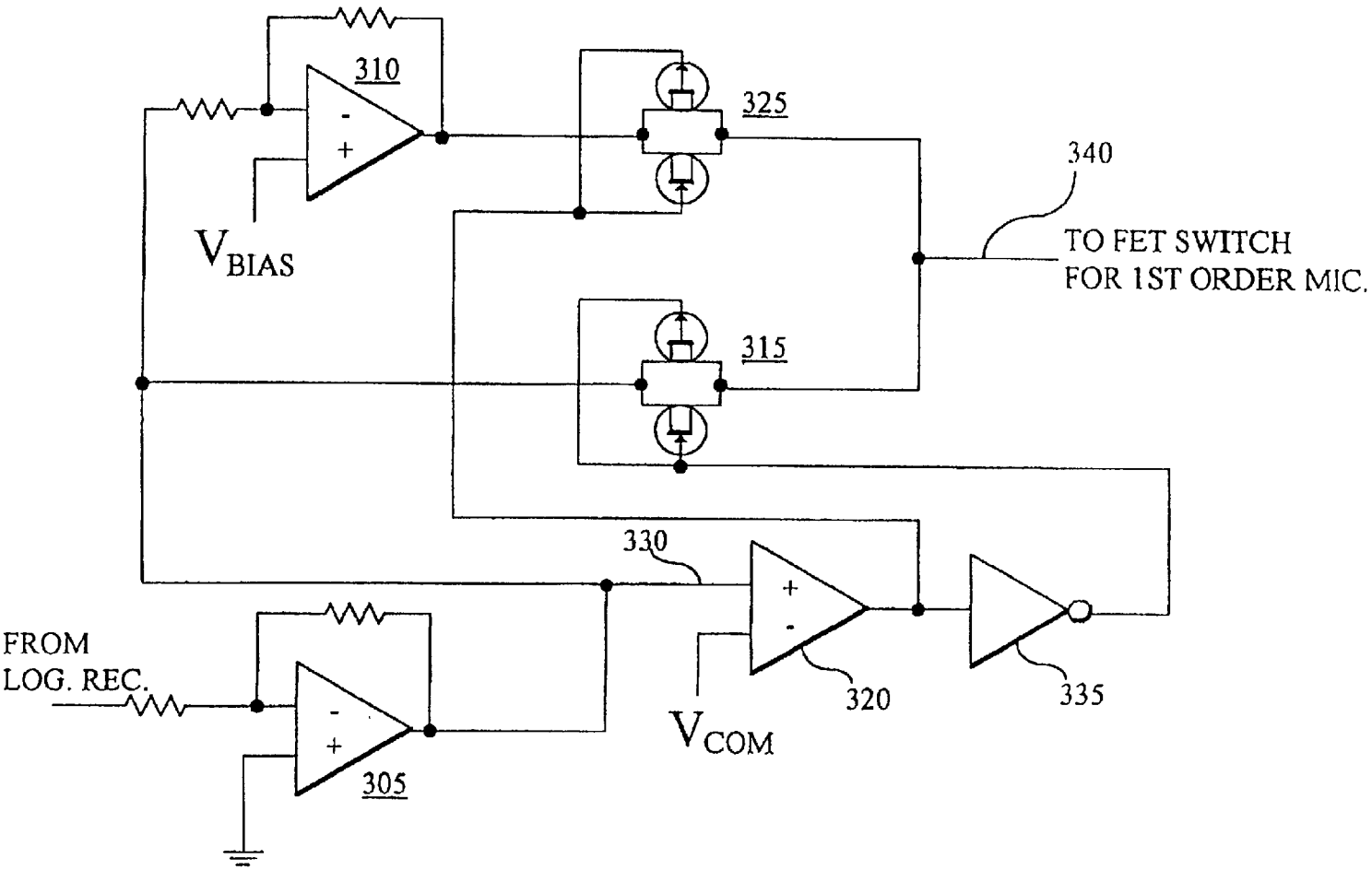

FIG. 15 shows an alternative circuit for driving the FET switch of the first order microphone 295 in FIG. 14 or first order microphone 235 in FIG. 13. As illustrated, the output of logarithmic rectifier 270 is supplied to the input of an inverting amplifier circuit 305. The output of inverting amplifier 305 is supplied to the input of a further inverting amplifier circuit 310, to an FET switch 315, and to the positive input of comparator 320 for comparison with a comparison voltage $V_{COM}$. The output of inverting amplifier circuit 310 is biased by a voltage $V_{BIAS}$ and supplied to FET switch 325.

Comparator 320 compares the voltage at line 330 with the voltage $V_{COM}$ and supplies a binary state signal output based on the comparison. The binary output is supplied as the control voltage to FET switch 345 and to the input of a logic inverter 335. The output of logic inverter 335 is supplied as the control voltage to FET switch 315. The outputs of the FET switches 315 and 325 are supplied as the control voltage for the FET switch associated with the first order microphone response.

In operation, $V_{COM}$ represents the sound pressure level at which the first order microphone output to the hearing aid amplifier begins to be attenuated. The output of inverting amplifier 305 is supplied as the control voltage to the first order microphone FET switch through FET switch 315 for voltage levels below $V_{COM}$ and gradually increases up to that point with increasing sound pressure level. For voltages above $V_{COM}$, the output of inverting amplifier 305 is effectively disconnected from the first order FET switch and is replaced by the voltage output of inverting amplifier 310 which gradually decreases with increasing sound pressure level. The magnitude of $V_{BIAS}$ is chosen so that there is a smooth transition of the control voltage output at line 340.

Figure 16:
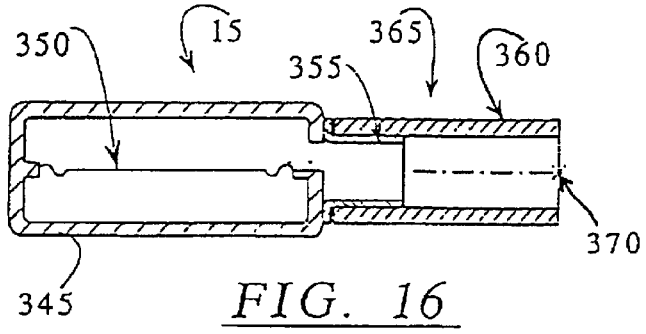
FIGS. 16 and 17 are cross sectional views showing the mechanical construction of various microphones suitable for use in the various hearing aid embodiments set forth herein.

FIG. 16 shows an omnidirectional pressure type microphone 15 commonly used in hearing aid applications. The omnidirectional microphone 15 includes a hollow body portion 345 having a diaphragm 350 disposed therein. An inlet tube 355 extends from the hollow body portion 345 and engages extension tubing 360 to form a sound port 365. Sound received at effective sensing point 370 will be transmitted into the hollow body portion 345 to vibrate diaphragm 350 which transduces the sound wave into an electrical signal.

Figure 17:
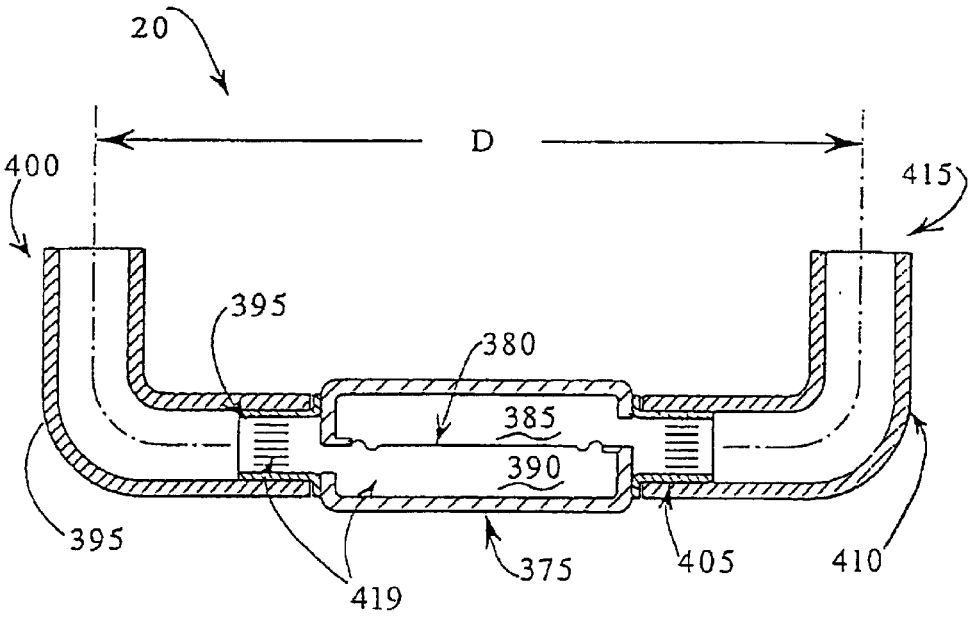

FIG. 17 illustrates a gradient first order directional microphone 20 that may be employed in the hearing aid apparatus set forth herein. The directional microphone 20 includes a hollow body portion 375 having a diaphragm 380 disposed therein that divides the interior of the hollow body portion 375 into two chambers 385 and 390. A first inlet tube 395 extends from the hollow body portion 375 and is connected to extension tube 395 to define a first sound port shown generally at 400. A second inlet tube 405 extends from the hollow body portion 375 and is connected to extension tube 410 to define a second sound port shown generally at 415. A time delay acoustical network, defined generally at 420 may also be employed. As is understood by those of ordinary skill in the art, the effective port spacing D determines the sensitivity of the microphone as well as its high frequency response. Sound waves received at sound ports 400 and 415 will respectively travel to chambers 390 and 385 to cause a differential pressure force on diaphragm 380. This differential pressure force is transduced by diaphragm 380 into an electrical output signal.

Figure 18:
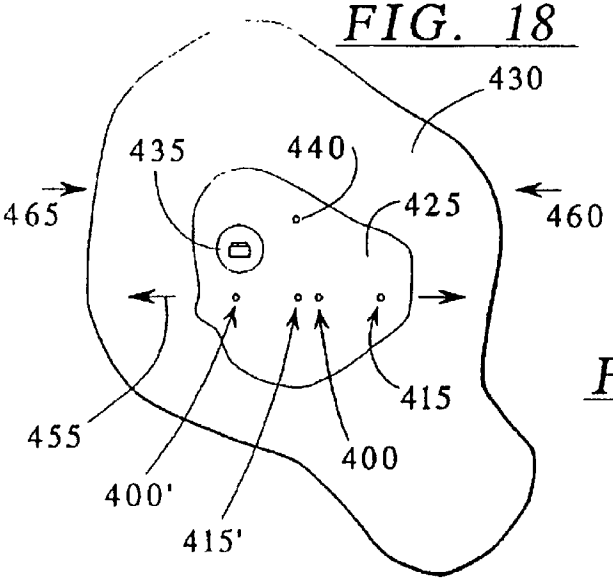
FIG. 18 is a perspective view of a hearing aid constructed in accordance with the invention as inserted into an ear.

FIGS. 18–21 show various mechanical constructions that may be employed in the hearing aid embodiments described above. As illustrated, the hearing aid includes a housing 420 having an aperature over which a face plate 425 is disposed. The housing 420 is sized to fit within the ear 430 of a hearing aid user and contains the hearing aid amplifier and speaker (not shown) as well as an omnidirectional microphone and at least one directional microphone. A switch 435 may optionally be provided through the face plate 425 to allow a hearing aid user to manually switch between the omnidirectional microphone and the directional microphone. The sound port 440 of the omnidirectional microphone extends through face plate 425. In the embodiment shown, the directional microphone is a second order directional microphone that is constructed from two first order gradient directional microphones 445 and 450 of the type described above. Each first order directional microphone includes a respective pair of spaced apart sound ports 400, 415, and 400', 415'. The sound ports 400, 415, 400' and 415' of the first order microphones may be arranged along line 455 as shown in FIG. 18 so that they are generally collinear. The second order directional microphone formed from the two first order directional microphones will tend to be highly sensitive to frontal sound waves received in the direction shown by arrow 460 while being generally insensitive to rear sound waves received in the direction shown by arrow 465.

Figure 20:
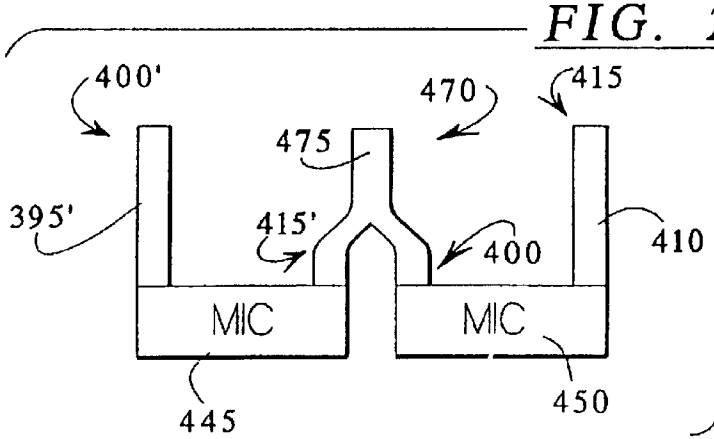
FIG. 20 is a perspective view showing an alternate mechanical construction of the second order microphone shown in FIG. 19.

An alternative construction of a second order microphone formed from two first order microphones is shown in FIG. 20. Rather than having all four sound ports connected through face plate 425, this embodiment has three sound ports. The central sound port 470 is formed by interconnecting sound port 415' of directional microphone 445 to sound port 400 of directional microphone 450. The diameter of extension tube 475 is approximately 1.4 times the diameter of the extension tubes 395' and 410 of sound ports 400' and 415 to compensate for this interconnection.

Figure 19:
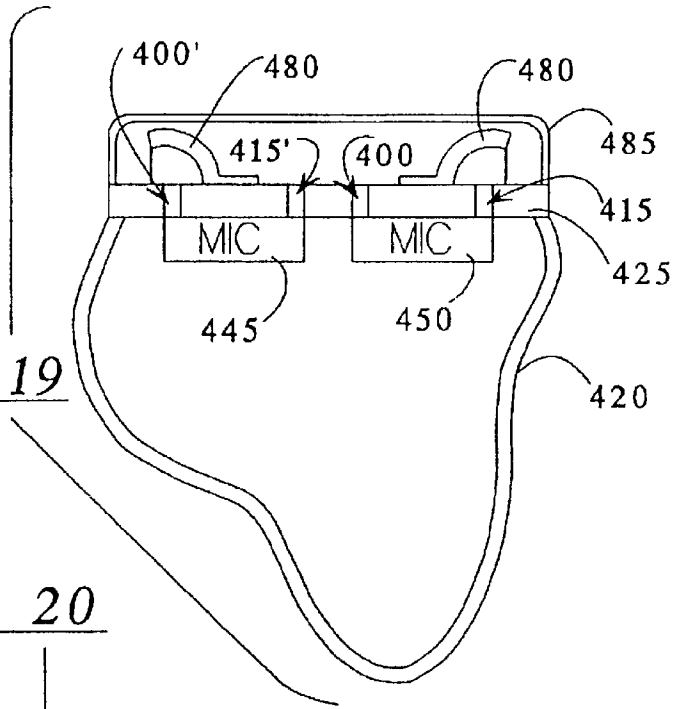
FIG. 19 is a cross sectional view showing certain mechanical structures of one embodiment of a hearing aid in accordance with the invention.
Figure 21:
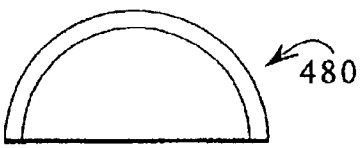
FIG. 21 is a front view of the diffraction scoop used in FIG. 19.

FIG. 19 illustrates two additional mechanical structures that can be used to increase the signal-to-noise ratio of the hearing aid. First, a pair of diffraction scoops 480 may be disposed respectively above sound ports 400' and 415. The diffraction scoops 480 tend to increase the effective port spacing and thus increase the sensitivity of the directional microphone. A front view of a diffraction scoop 480 is shown in FIG. 21. Second, a wind screen 485 is disposed over the diffraction scoops 480 and at least a portion of face plate 425. The wind screen 485 may be in the form of a porous screen or a multiply perforate molded housing.

The hearing aid apparatus disclosed herein results from a new understanding of the problems associated with the use of directional microphones in hearing aids. A first understanding is that directional microphones, particularly second-order directional microphones, offer the possibility of an expected directivity index of some 9.0 dB in head-worn applications. The improvement over an omnidirectional head-worn microphone thus becomes an attractive 6 dB at high frequencies and nearly 9 dB at low frequencies. The improvement in effective signal-to-noise ratio for speech of 34 dB for a first-order directional microphone, might reasonably be extrapolated to an expected 6.5–7.5 dB improvement in single-to-noise ratio for a second-order directional microphone.

Although the equalization required for practical application of directional microphones in hearing aids itself results in increased noise, the applicants have realized a second understanding that in many, if not most, of those circumstances where the background noise level interferes with conversation speech, the background noise level itself will mask the added noise. Since an omnidirectional microphone may be switched to the input of the hearing aid amplifier under low ambient noise level conditions, the added noise does not present a problem for the hearing aid user.

While several embodiments of the invention have been described hereinabove, those of ordinary skill in the art will recognize that these embodiments may be modified and altered without departing from the central spirit and scope of the invention. Thus, the preferred embodiments described hereinabove are to be considered in all respects as illustrative and not restrictive, the scope of the invention being indicated by the appended claims rather than by the foregoing description. Therefore, it is the intention of the inventors to embrace herein all such changes, alterations and modifications which come within the meaning and range of equivalency of the claims.

What is claimed is:

1. A hearing aid comprising:

A. a hearing aid housing for mounting with an ear of a hearing aid user, the hearing aid housing having an outer surface comprising a face plate defining an exterior surface of said hearing aid housing as worn, said hearing aid housing being of size and shape to fit into the ear of the hearing aid user; and B. a second order directional microphone mounted within said hearing aid housing, said second order directional microphone comprising a plurality of microphones, each of the plurality of microphones having (i) a microphone housing;

(ii) a diaphragm mounted within the microphone housing, said diaphragm dividing said microphone housing into a first chamber and a second chamber; and (iii) at least one sound passage communicating with at least the first chamber.

2. The hearing aid of claim 1 wherein the at least one sound passage comprises a first sound passage and a second sound passage, and wherein the first sound passage communicates with the first chamber and the second sound passage communicates with the second chamber.

3. The hearing aid of claim 1 wherein the plurality of microphones comprise a plurality of directional microphones.

4. The hearing aid of claim 3 wherein the plurality of directional microphones comprise a plurality of first order directional microphones.

5. A hearing aid comprising:

A. a hearing aid housing for mounting with an ear of a hearing aid user, the hearing aid housing having an outer surface comprising a face plate defining an exterior surface of said hearing aid housing as worn, said hearing aid housing being of size and shape to fit into the ear of the hearing aid user; and B. a second order directional microphone mounted within said hearing aid housing, said second order directional microphone comprising a plurality of microphones, each of the plurality of microphones having (i) a housing;

(ii) a diaphragm mounted within said housing, said diaphragm dividing said housing into a first chamber and a second chamber, said housing having at least a first opening; and (iii) at least one sound passage for receiving sound from a sound field external to said outer surface, said sound passage communicating with said first chamber through said first opening in said housing.

6. The hearing aid of claim 5 wherein the at least one sound passage comprises a first sound passage and a second sound passage and the at least a first opening comprises a first opening and a second opening, and wherein the first sound passage communicates with the first chamber through the first opening and the second sound passage communicates with the second chamber through the second opening.

7. The hearing aid of claim 5 wherein the plurality of microphones comprise a plurality of directional microphones.

8. The hearing aid of claim 7 wherein the plurality of directional microphones comprise a plurality of first order directional microphones.

9. A hearing aid comprising:

a hearing aid housing for mounting with an ear of a hearing aid user, the hearing aid housing having an outer surface comprising a face plate defining an exterior surface of said hearing aid housing as worn, said hearing aid housing being of size and shape to fit into the ear of the hearing aid user; and a second order directional microphone mounted within the hearing aid housing, comprising a plurality of microphones;

a first sound passage for receiving sound from a sound field external to said outer surface;

a second sound passage for receiving sound from a sound field external to said outer surface; and a third sound passage for receiving sound from a sound field external to said outer surface.

10. The hearing aid of claim 9 wherein the plurality of microphones comprise a plurality of directional microphones.

11. The hearing aid of claim 10 wherein the plurality of directional microphones comprise a plurality of first order directional microphones.

12. A hearing aid comprising:

a hearing aid housing for mounting with an ear of a hearing aid user, the hearing aid housing being of site and shape to fit into the ear of the hearing aid user;

a face plate that forms an outer surface of said hearing aid housing; and a second order directional microphone mounted within the hearing aid housing, the second order directional microphone comprising a plurality of microphones;

a first sound passage;

a second sound passage; and a third sound passage.

13. The hearing aid of claim 12 wherein the plurality of microphones comprise a plurality of directional microphones.

14. The hearing aid of claim 13 wherein the plurality of directional microphones comprise a plurality of first order directional microphones.

15. A hearing aid comprising:

a hearing aid housing for mounting with an ear of a hearing aid user, the hearing aid housing being of size and shape to fit into the ear of the hearing aid user and having an outer surface defining an exterior surface of a hearing aid housing as worn, said outer surface comprising a face plate and having first, second and third sound openings therein, said first, second and third sound openings for receiving sound from a sound field external to said outer surface; and a second order directional microphone mounted within said hearing aid housing, comprising a plurality of microphones;

a first sound passage acoustically coupled to said first opening in said outer surface, said first sound passage for receiving sound from said sound field and for coupling received sound to one of said plurality of microphones;

a second sound passage acoustically coupled to said second opening in said outer surface, said second sound passage for receiving sound from said sound field and for coupling received sound to one of said plurality of microphones; and a third sound passage acoustically coupled to said third opening in said outer surface, said third sound passage for receiving sound from said sound field and for coupling received sound to one of said plurality of microphones.

16. The hearing aid of claim 15 wherein the plurality of microphones comprise a plurality of directional microphones.

17. The hearing aid of claim 16 wherein the plurality of directional microphones comprises a plurality of first order directional microphones.

18. A hearing aid comprising:

a hearing aid housing for mounting with an ear of a hearing aid user, the hearing aid housing being of size and shape to fit into the ear of the hearing aid user and having an outer surface defining an exterior surface of said hearing aid housing as worn, said outer surface comprising a face plate;

a plurality of microphones mounted within the hearing aid housing;

a first sound passage for receiving sound from a sound field external to said outer surface;

a second sound passage for receiving sound from a sound field external to said outer surface; and a third sound passage for receiving sound from a sound field external to said outer surface;

the hearing aid providing a second order directional response.

19. The hearing aid of claim 18 wherein the plurality of microphones comprise three microphones.

20. The hearing aid of claim 18 wherein the plurality of microphones comprise a plurality of directional microphones.

21. The hearing aid of claim 20 wherein the plurality of directional microphones comprise a plurality of first order directional microphones.

22. The hearing aid of claim 18 wherein the plurality of microphones comprise at least one omnidirectional microphone.

23. A hearing aid comprising:

a hearing aid housing for mounting with an ear of a hearing aid user, the hearing aid housing being of size and shape to fit into the ear of the hearing aid user and having an outer surface defining an exterior surface of a hearing aid housing as worn, said outer surface comprising a face plate and having first, second and third sound openings therein, said first, second and third sound openings for receiving sound from a sound field external to said outer surface; and a plurality of microphones mounted within said hearing aid housing;

a first sound passage acoustically coupled to said first opening in said outer surface, said first sound passage for receiving sound from said sound field and for coupling received sound to one of said plurality of microphones;

a second sound passage acoustically coupled to said second opening in said outer surface, said second sound passage for receiving sound from said sound field and for coupling received sound to one of said plurality of microphones; and a third sound passage acoustically coupled to said third opening in said outer surface, said third sound passage for receiving sound from said sound field and for coupling received sound to one of said plurality of microphones;

the hearing aid providing a second order directional response.

24. The hearing aid of claim 23 wherein the plurality of microphones comprise three microphones.

25. The hearing aid of claim 23 wherein the plurality of microphones comprise a plurality of directional microphones.

26. The hearing aid of claim 25 wherein the plurality of directional microphones comprise a plurality of first order directional microphones.

27. The hearing aid of claim 23 wherein the plurality of microphones comprise at least one omnidirectional microphone.

* * * * *